US005305689A

United States Patent [19]

Schiel

[11] Patent Number: 5,305,689

[45] Date of Patent: Apr. 26, 1994

[54] TENSION BARS FOR ROLL PRESS FOR PAPER MAKING MACHINE

[75] Inventor: Christian Schiel, Heidenheim, Fed. Rep. of Germany

[73] Assignee: J.M. Voith GmbH, Fed. Rep. of Germany

[21] Appl. No.: 61,577

[22] Filed: May 13, 1993

[30] Foreign Application Priority Data

May 27, 1992 [DE] Fed. Rep. of Germany ..... 4217560

[51] Int. Cl.[5] ..... B30B 3/04

[52] U.S. Cl. ..... 100/169; 72/237; 100/162 B; 100/176; 162/272; 162/358.3

[58] Field of Search ..... 100/153, 176, 168–171, 100/162 B; 68/244, 256, 272, 274; 72/237, 245; 162/272, 273, 358.1, 358.3

[56] References Cited

U.S. PATENT DOCUMENTS

| | | | |
|---|---|---|---|
| 3,921,514 | 11/1975 | Biondetti | 100/176 X |
| 3,946,587 | 3/1976 | Maltby | 72/237 |
| 4,022,122 | 5/1977 | Moser et al. | 100/176 X |
| 4,028,035 | 6/1977 | Komarek | 100/176 X |
| 4,272,317 | 6/1981 | Roerig | 162/272 |
| 4,423,612 | 1/1984 | Uppaluri | 72/237 X |
| 4,691,421 | 9/1987 | Schiel | 100/155 R X |
| 4,796,452 | 1/1989 | Schiel | 72/245 |

FOREIGN PATENT DOCUMENTS

| | | | |
|---|---|---|---|
| 9200952.2 | 4/1992 | Fed. Rep. of Germany . | |
| 4110205 | 10/1992 | Fed. Rep. of Germany . | |
| 2024682 | 1/1980 | United Kingdom | 72/245 |

*Primary Examiner*—Stephen F. Gerrity
*Attorney, Agent, or Firm*—Ostrolenk, Faber, Gerb & Soffen

[57] ABSTRACT

The axes of a first press roll (1) and of a second press roll (3) lie in a press plane (E). Each of the press rolls has a respective journal (2, 4). The first press roll is supported in a first bearing bracket (5). The second press roll rests in a second bearing bracket (6) which is coupled, by means of flexurally soft tie-bar groups (7*a*, 7*b* . . . , 8*a*, 8*b* . . . ), to the first bearing bracket (5). In the unloaded condition, of the roll press, the second bearing bracket (6) rests on the first bearing bracket (5). In the loaded condition, however, a clearance (p) is established between the bearing brackets (5, 6), which permits the bearing brackets (5, 6) to be displaceable relative to each other in the axial direction of the press rolls.

24 Claims, 3 Drawing Sheets

TENSION BARS FOR ROLL PRESS FOR PAPER MAKING MACHINE

CROSS-REFERENCE TO RELATED APPLICATION

This is related to Ser. No. 07/946,325 filed Nov. 6, 1992, pending, which is expressly incorporated by reference herein.

BACKGROUND OF THE INVENTION

The present invention relates to a roll press having two press rolls, the main axes of which lie in a press plane and which form with each other a press nip.

German published patent application P 41 10 205.3, which corresponds to U.S. Ser. No. 07/946,325, discloses a roll press having a first press roll and a second press roll, the main axes of which lie in a press plane, and which form with one another a press nip, wherein:

a) each of the two press rolls has a rotatable roll shell, and either rotatable journals (fastened to the rotatable roll shell), or a stationary carrier with stationary journals, which extends through the roll shell;

b) the first press roll is supported on at least one of its two ends in a bearing bracket which is supported on a machine frame;

c) the second press roll is also supported on at least one of its two ends in a bearing bracket which is coupled to the bearing bracket of the first press roll by means of detachable tie bars which extend on both side of the press plane substantially parallel to the latter and perpendicular to the main axes of the press rolls;

d) the detachable tie bars are low in tension in the unloaded condition of the roll press; and e) the tie bars are movable substantially in the direction of the main axes in such a manner that—in the loaded condition of the roll press—the bearing bracket of the second press roll is movable in the press plane relative to the bearing bracket of the first press roll.

According to the foregoing publication, at least one of the two ends of the roll press, [supports] at each press roll is supported in a bearing bracket. The two bearing brackets are coupled to each other by detachable tie bars. These tie bars extend on both sides of the press plane substantially parallel to said plane and perpendicular to the main axes of the press rolls.

In the unloaded condition of the roll press the tie bars are low in tension, i.e., they are only under a slight tensile stress, which under certain circumstances may be equal to zero. Thus, in this condition, very easy and rapid removal of the tie bars is possible when it is desired to replace, for instance, a felt belt which during operation passes through the press nip, or the roll shell.

Furthermore, tie bars are movable substantially in the direction of the axes of the rolls in such a manner that, in the loaded condition of the roll press, the bearing brackets are movable relative to each other. For instance, one of the bearing brackets can move in the axial direction relative to the other and/or tilt in the press plane. In this way, this bearing bracket can be rigidly coupled to the journals of the corresponding press roll. Nevertheless, longitudinal elongation (caused thermally) of the roll body or the stationary support body is possible. Furthermore, tilting of the journal is possible. Such tilting may be the result of sagging of the roll body or the support body.

The tie bars are provided, in accordance with the foregoing publication, with two hammer heads and are developed preferably in the form of a leaf spring, the plane of the leaf being substantially perpendicular to the press plane. The tie bars can be inserted from the side into recesses in the bearing brackets. For this, a relatively large amount of space is required, as seen in the axial direction, on both sides of the bearing brackets.

The disclosures of these and all other prior art mentioned herein are expressly incorporated by reference.

SUMMARY OF THE INVENTION

The present invention, therefore, has the principal object of further developing the roll press described in the foregoing publication in such a manner that it is possible to install and remove the tie bars without requiring any free space laterally alongside the bearing brackets to be available for this.

This object is achieved by providing, on each of the two sides of the press plane, a series or group of at least two tie bars, which lie in a plane which is at least approximately parallel to the press plane, and the tie bars being insertable along that plane into engagement with the bearing brackets.

In accordance therewith, instead of a single tie bar on each of the two sides of the press plane being provided, as in the German publication, there are a series of at least two (and preferably more than two) tie bars on each side. This series of tie bars extends parallel to the press plane; i.e., the tie bars or the series of tie bars all lie in a plane which is at least approximately parallel to the press plane, namely a so-called tie-bar plane. The recesses provided in the bearing brackets to receive the tie bars also extend parallel to the press plane. In other words, the tie bars can be inserted into or removed from the bearing brackets along the tie-bar plane.

Due to the fact that, on each of the two sides of the press plane, there is a series or group of tie bars lying one behind the other, instead of a single tie bar, an important property of the tie bars is retained, namely that they are flexurally soft in the direction of the main axes of the press rolls. In this way, the above-mentioned relative movability of the two bearing brackets with respect to each other is assured.

Another prior art publication, Federal Republic of Germany Utility Model 92 00 952, discloses an arrangement having two tie bars, in which the tie bars can be inserted into the bearing brackets in the direction of the roll axes. However, only a signal tie bar is present on each of the two sides of the press plane. Further, in this arrangement, the tie bars are not flexurally soft in the direction of the press roll axes. This results in the disadvantage that upon displacement of one bearing bracket relative to the other bearing bracket, edge pressure is produced on the tie bars.

Other features and advantages of the present invention will become apparent from the following detailed description of embodiments of the invention which refers to the accompanying drawings.

DETAILED DESCRIPTION

Figure 1:
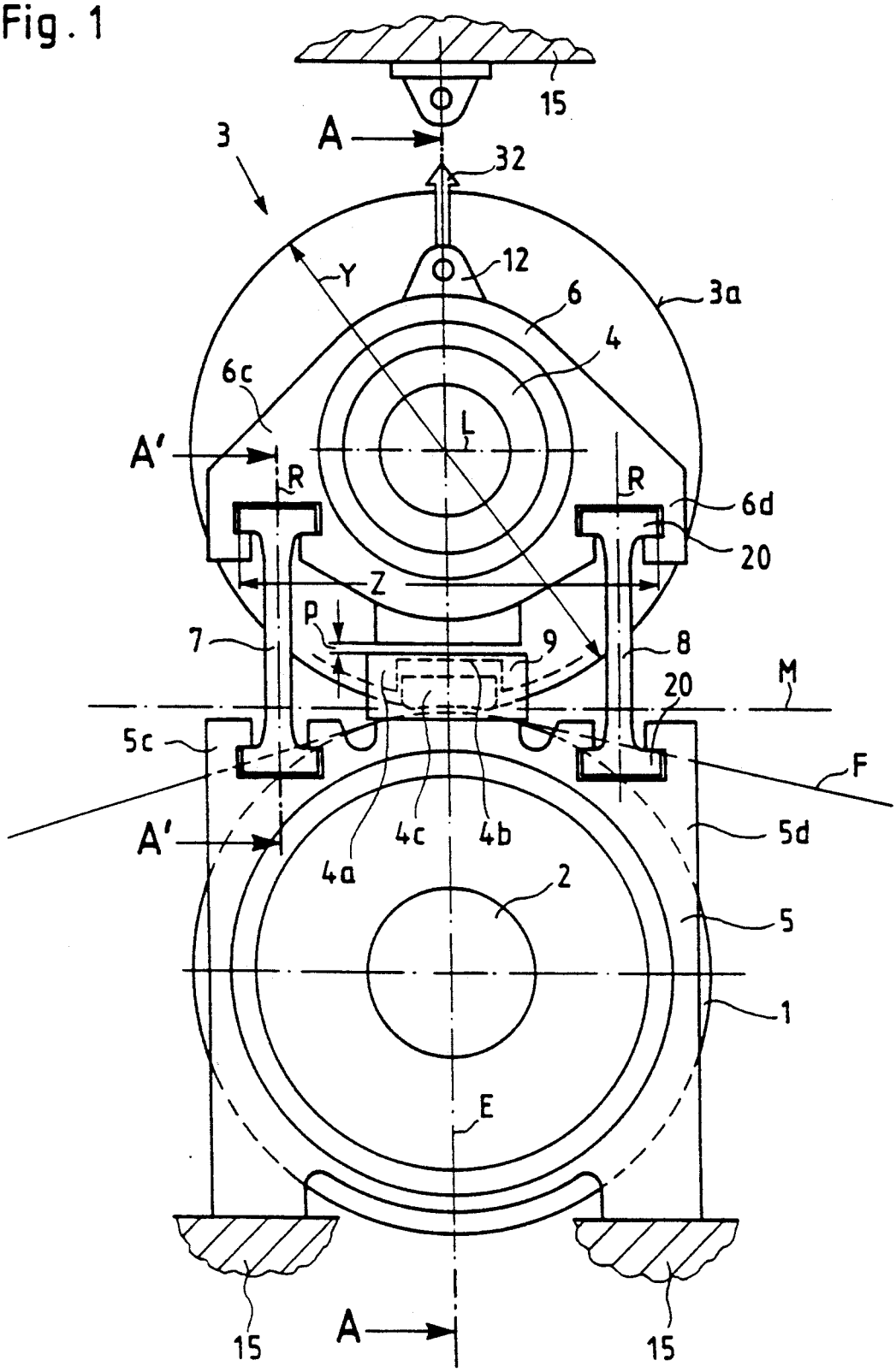
FIG. 1 is a side view of a roll press, as seen in the direction of the arrow I in FIG. 1A.
Figure 1A:
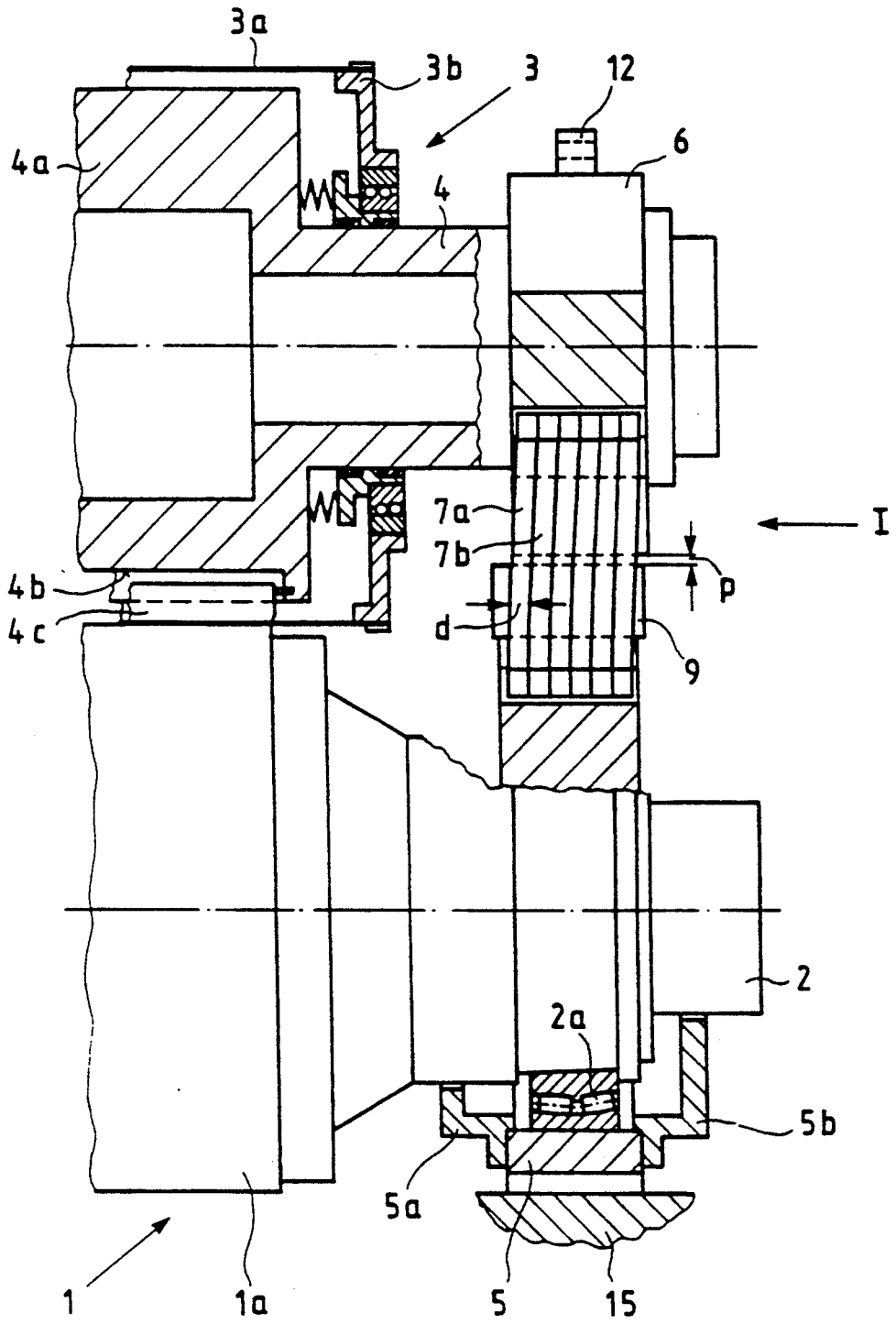
FIG. 1A is, in part, a longitudinal section along the line A—A and, in part, a longitudinal section along the line A'—A' of FIG. 1.

The roll press shown in FIGS. 1 and 1A has a bottom first press roll 1 and a top second press roll 3. The main axes of these press rolls (these are the axes of rotation in the embodiment shown) lie in a press plane E. The first press roll 1 has a rotatable roll shell 1*a* and a journal 2 which is fastened to it, the journal resting via an anti-friction bearing 2*a* (preferably a self-aligning roller bearing) in a bearing bracket 5 (having covers 5*a* and 5*b*). The bearing bracket 5 is arranged on a frame-shaped machine frame 15, parts of which are indicated in FIG. 1. The anti-friction bearing 2*a* can be axially displaceable in the bearing bracket 5 in order to permit a change in length (caused, for instance, by heat) of the press roll 1. For this purpose, it is, however, also possible to couple the bearing bracket 5 in axially movable manner to the machine frame 15, for instance in accordance with U.S. Pat. No. 4,272,317.

The upper, second press roll 3 is a so-called long-nip press roll. Its rotatable roll shell 3*a* is a tubular, flexible press shell which is fastened to two rotatable shell support disks 3*b*. Each shell support disk rests on the stationary journal 4 of a stationary support body 4*a* which extends through the inside of the roll shell 3*a*.

In another embodiment of the invention, not shown, the axis of rotation of the roll shell 3*a* may be arranged eccentric relative to the main axis of the support body 4*a*.

The support body 4*a* has a recess 4*b* facing the lower press roll 1 and, within it, a piston-shaped hydraulically actuatable press shoe 4*c*. The concave slide surface of the latter presses the press shell 3*a* against the lower press roll 1 in order thereby to form a lengthened press nip, which is elongated in the direction of travel. Through this nip there travels a web of paper from which the water is to be removed, together with at least one endless felt belt F. The upper press roll 3 rests (at each roll end) via the journal 4 in a bearing bracket 6.

Between the bearing brackets 5 and 6 there is a removable intermediate piece 9 which lies on the bearing bracket 5. The bearing bracket 6 of the upper press roll 3 rests on the intermediate piece 9 when the roll press is in its unloaded state, i.e., when the recess 4*b* has no pressure applied to it. However, the loaded condition is shown in the drawing, in which condition the press shoe 4*c* exerts a pressing force on the lower press roll 1. The forces of reaction which result therefrom are transmitted by means of flexurally soft tie bars 7*a*, 7*b* . . . and 8*a*, 8*b* . . . from the bearing bracket 6 to the bearing bracket 5.

In accordance with FIG. 1, groups 7, 8 of tensile tie bars are provided on each side of the press plane E. The tie bars are inserted from the direction of the end, and therefore in a direction parallel to the roll axes, into recesses in the bearing brackets 5 and 6. Each of the flexurally soft tie bars has a hammer head 20 on each end. The tie bars can be deformed as shown in FIG. 1A if the support body 4, 4*a* of the second press roll 3 experiences a change in length (for instance caused by heat) and/or sags under the pressing force. Accordingly, the bearing bracket 6 can be rigidly connected to the journal 4, unlike in prior art arrangements, which required axial slide surface between these two parts and/or a spherical socket. Due to sagging of the support body, journal 4 and bearing bracket 6 together are inclined by a very small angle. This is entirely permissible since the tie bars, or each group of tie bars, can readily bend into an S-shape (FIG. 1A) without the tensile forces on the individual tie bars being of different value.

Aside from the deformability of the tie bars, an additional advantageous feature assures the easy axial displaceability and/or inclinability of the bearing bracket 6 when the support body 4, 4*a* changes length or sags. In the unloaded condition of the roll press, the tie bars 7*a*, 7*b* . . . and 8*a*, 8*b* . . . are either not prestressed at all or only very slightly prestressed. Then, in the loaded condition of the roll press, the bearing bracket 6 of the upper press roll 3 lifts off slightly from the intermediate piece 9. In other words, clearance p is formed between the bearing brackets 5 and 6. The introduction of a new endless felt belt F into the roll press is effected, of course, in the unloaded condition, this being done from the one end of the roll, in the direction of the arrow I in FIG. 1A. In the unloaded condition, the upper press roll 3 initially rests on the intermediate piece 9. The tie bars are now removed, the upper press roll 3 is lifted by a lifting device (symbolically represented by arrow 32) which acts on the lugs 12, the intermediate piece 9 is removed, and the endless felt belt F is introduced. The intermediate piece 9 is then again inserted and the press roll 3 is replaced thereon, whereupon the tie bars are again mounted. This work can be carried out within a relatively short time.

The length of the flexurally soft tie bars 7, 8 preferably amounts to 0.4 to 1.2 meters. In FIG. 1, a center plane which is perpendicular to the press plane E and passes through the press nip is designated M. Arms 5*c* and 5*d* are formed on the bearing bracket 5, extending in the direction towards the press nip plane M. In each arm there is a T-groove which is open on top in order to receive one of the groups 7, 8 of tie bars. The bearing bracket 6 has on each of its sides, approximately at the height of the central plane L (in which the axis of rotation of a roll lies) two arms 6*c* and 6*d* with T-grooves which are open towards the bottom, again in order to receive the tie bars.

The cross-section and material of the tie bars are selected so that the so-called yield point of the tie bars is reached when the normal maximum pressing force of the roll press is exceeded by about 50 to 100% as a result of a disturbance, for instance when a foreign body enters into the press nip. In other words, the tie bars form a portion of the arrangement which is intended to stretch in the event of a disturbance, preventing the occurrence of greater damage.

The installing and removing of the tie bars can be effected manually due to the fact that each group 7, 8 of tie bars is divided into several sufficiently light individual tie bars of relatively slight thickness, for instance, six in accordance with FIG. 1A.

In order for the aforementioned replacement of the flexible roll shell 3*a*, in the case of a long nip press roll 3, to be carried out without difficulty (after removal of the tie bars 7 and 8 and the intermediate piece 9), the following features are provided according to the invention.

In accordance with FIG. 1, the arms 6*c*, 6*d* of the bearing bracket 6 which supports the long-nip press roll 3 do not extend substantially beyond the path of rotation of the roll shell 3*a*. Thus, the roll shell 3*a* can be pulled off over the bearing bracket 6; the latter, therefore, need not be removed.

During the changing of the roll shell, the end of the long-nip press roll 3 which is visible in FIG. 1A is not lifted by means of the lug 12 but rather, in known manner, by means of an auxiliary device (not shown) which is fastened on the journal 4.

Due to the fact that, as already mentioned, the arms 6c and 6d lie within the circumferential path of the roll shell 3a, the distance Z between the outer contours of the tie-bar groups 7 and 8 is, in general, less than the diameter Y of the long-nip press roll 3. More generally, the distance Z is smaller, or at most very slightly larger, than the diameter Y of the larger of the two press rolls 1 or 3. This is true regardless of which of the two press rolls has the larger diameter and regardless of whether or not one of the two press rolls is developed as a long-nip press roll.

The roll press shown in FIGS. 1 and 1A has the radially movable press shoe 4c and therefore is a so-called self-loading roll press (in other words, a roll press with an inner pressing device). The invention can also be used with, instead of the long-nip press roll 3 shown, a press roll with adjustable sag, for instance one in accordance with U.S. Pat. No. 4,691,421; this is also a roll press with an inner pressing device. Other roll combinations are also conceivable, including ones with an outer pressing device in accordance, for instance, with U.S. Pat. No. 4,796,452. In this connection, two normal press rolls (i.e., both with rotatable roll journals) can also be used in a roll press in accordance with the invention.

In accordance with FIG. 1A, the tie bars 7a, 7b . . . of a tie-bar group each have a constant thickness d over their entire length; in other words, the heads and the shank of each tie bar are of the same thickness. In this case, the tie bars of a group of tie bars can rest against each other over their entire length, even in a deformed condition, as shown in FIG. 1A.

Figure 2:
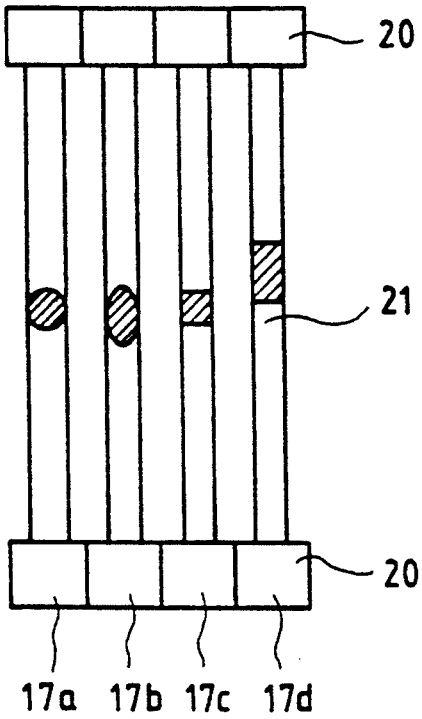
FIG. 2 shows structural shapes of various tie bars which differ from those of FIG. 1A.

Alternatively, in accordance with FIG. 2, the shank 21 of each tie bar 17a–17d may have a smaller thickness than its heads 20. Thus, in the installed condition, only the heads of the tie bars of a group of tie bars contact each other.

Different shank cross-sections are diagrammatically shown in FIG. 2. Therefore a circular, elliptical, square or rectangular cross-section, for instance, is possible. In the case of a rectangular cross-section, the long sides of the rectangle extend preferably transverse to the press plane so as to obtain the greatest possible flexural softness of the tie bars in the direction of the roll axes.

Figure 3:
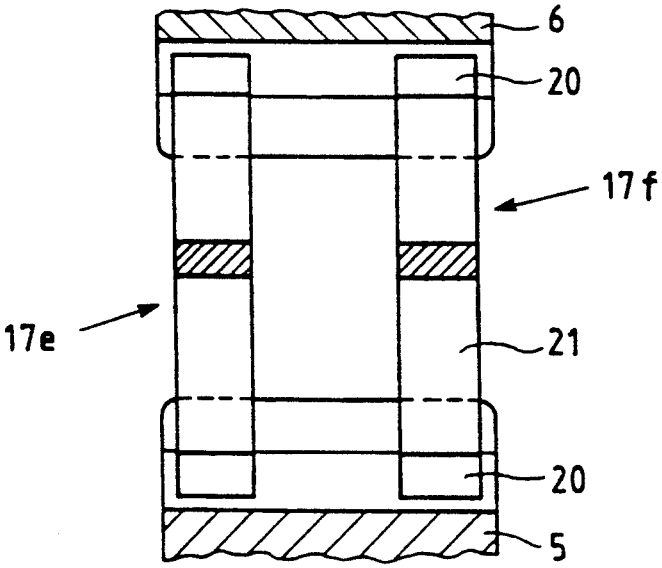
FIG. 3 shows another possible shape of tie bar, the angle of view in FIGS. 2 and 3 being the same as in FIG. 1A.

The opposite, however, is also possible. In accordance with FIG. 3, a group of tie bars may include only two tie bars 17e and 17f. Of them, each has a shank of a rectangular cross-section, the long sides of the rectangle extending parallel to the press plane. This structural shape is advantageous if there is spherical mobility of the bearings on the shafts.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. In a roll press having a first press roll and a second press roll having main axes which define a press plane and which form with one another a press nip, the roll press having a loaded condition and an unloaded condition, and wherein:

a) each of the press rolls has a rotatable roll shell and means for permitting the roll shell to rotate about the axis of the press roll;

b) the first press roll is supported on at least one end in a first bearing bracket which is in turn supported on a machine frame;

c) the second press roll is supported on at least one end in a second bearing bracket which is coupled to the first bearing bracket by means of detachable tie bars, which are arranged on both sides of the press plane substantially parallel to the latter and perpendicular to the main axes of the press rolls;

d) the detachable tie bars being low in tension in the unloaded condition of the roll press;

e) the tie bars being movable substantially in the direction of the main axes of the press rolls in such a manner as to permit, in the loaded condition of the roll press, the second bearing bracket of the second press roll to be movable relative to the first bearing bracket of the first press roll;

the improvement wherein:

f) each of the tie bars, which couple the first and second bearing brackets, comprises a group of at least two tie bars arranged in a plane which is approximately parallel to the press plane; and g) attachment means permits the tie bars to be inserted into the bearing brackets along said plane of said tie bars for being attached to the bearing brackets.

2. A roll according to claim 1, wherein each tie bar is flexurally soft in the direction of the main axes of the press rolls.

3. A roll press according to claim 2, wherein each of the flexurally soft tie bars has a shank, and a head on each of two ends of the shank.

4. A roll press according to claim 3, wherein said heads on each tie bar are hammer-shaped.

5. A roll press according to claim 3, wherein the shank of each tie bar has a substantially rectangular cross-section.

6. A roll press according to claim 3, wherein the shank of each tie bar has a rounded cross-section.

7. A roll press according to claim 6, wherein said cross-section is substantially circular.

8. A roll press according to claim 6, wherein said cross-section is substantially elliptical.

9. A roll press according to claim 3, wherein the shank has a thickness which is approximately equal to the thickness of the two heads, measured in a direction substantially parallel to the press plane.

10. A roll press according to claim 3, wherein the shank has a thickness which is less than the thickness of the two heads, measured in a direction substantially parallel to the press plane.

11. A roll press according to any one of claims 1–3, 5, 6, 9 and 10, wherein a transverse extent of the tie bars, measured transversely to the press plane between outermost contours of the tie-bar groups most remote from the main press roll axes, is not substantially greater than a maximum diameter of the first and second press rolls.

12. A roll press according to claim 11, in which at least one press roll is a long-nip press roll with a tubular flexible roll shell, and said transverse distance is less than the diameter of the long-nip press roll, and said attaching means for attaching the tie bars to the bearing bracket of the long-nip press roll are on a pair of arms which are arranged substantially within the path of rotation of the roll shell, as seen in the axial direction of said press rolls.

13. A roll press having a first press roll and a second press roll, having main axes which define a press plane and which form with one another a press nip, the roll press having a loaded condition and an unloaded condition, wherein:

a) each of the two press rolls has a rotatable roll shell and means for permitting the roll shell to rotate about the axis of the press roll;

b) the first press roll is supported on at least one end in a first bearing bracket which is in turn supported on a machine frame;

c) the second press roll is supported on at least one end in a second bearing bracket which is coupled to the first bearing bracket by two groups of detachable tie bars arranged on respective sides of the press plane, each group comprising at least two tie bars arranged in a plane which is approximately parallel to the press plane;

d) the tie bars are movable substantially in the direction of the main axes of the press rolls in such a manner that in the loaded condition of the roll press the second bearing bracket of the second press roll is movable in the press plane relative to the first bearing bracket of the first press roll; and e) the bearing brackets and tie bars have attachment means permitting the tie bars to be inserted into the bearing brackets along said plane of said tie bars for being attached to the bearing brackets.

14. A roll according to claim 13, wherein each tie bar is flexurally soft in the direction of the main axes of the press rolls.

15. A roll press according to claim 14, wherein each of the flexurally soft tie bars has a shank, and a head on each of two ends of the shank.

16. A roll press according to claim 15, wherein said heads on each tie bar are hammer-shaped.

17. A roll press according to claim 15, wherein the shank of each tie bar has a substantially rectangular cross-section.

18. A roll press according to claim 15, wherein the shank of each tie bar has a rounded cross-section.

19. A roll press according to claim 18, wherein said cross-section is substantially circular.

20. A roll press according to claim 18, wherein said cross-section is substantially elliptical.

21. A roll press according to claim 15, wherein the shank has a thickness which is approximately equal to the thickness of the two heads, measured in a direction substantially parallel to the press plane.

22. A roll press according to claim 15, wherein the shank has a thickness which is less than the thickness of the two heads, measured in a direction substantially parallel to the press plane.

23. A roll press according to claim 13, wherein a transverse extent of the tie bars, measured transversely to the press plane between outermost contours of the tie-bar groups most remote from the main press roll axes, is not substantially greater than a maximum diameter of the first and second press rolls.

24. A roll press according to claim 23, in which at least one press roll is a long-nip press roll with a tubular flexible roll shell, and said transverse distance is less than the diameter of the long-nip press roll, and said attaching means for attaching the tie bars to the bearing bracket of the long-nip press roll are on a pair of arms which are arranged substantially within the path of rotation of the roll shell, as seen in the axial direction of said press rolls.

* * * * *